US009720368B2

(12) United States Patent
Nishio

(10) Patent No.: US 9,720,368 B2
(45) Date of Patent: Aug. 1, 2017

(54) IMAGE FORMING APPARATUS AND POWER SUPPLY FAILURE DETECTION METHOD

(71) Applicant: Takuma Nishio, Kanagawa (JP)

(72) Inventor: Takuma Nishio, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/260,205

(22) Filed: Sep. 8, 2016

(65) Prior Publication Data

US 2017/0082967 A1 Mar. 23, 2017

(30) Foreign Application Priority Data

Sep. 18, 2015 (JP) ..... 2015-184968

(51) Int. Cl.
*G03G 15/00* (2006.01)
*G03G 21/16* (2006.01)

(52) U.S. Cl.
CPC ..... *G03G 15/80* (2013.01); *G03G 21/1633* (2013.01)

(58) Field of Classification Search
USPC ..... 399/9, 31, 32, 37, 38, 42, 51, 107, 110, 399/114
See application file for complete search history.

(56) References Cited

U.S. PATENT DOCUMENTS

| | | | | |
|---|---|---|---|---|
| 4,739,367 | A * | 4/1988 | Watanabe | G03G 15/08 399/111 |
| 7,574,150 | B2 * | 8/2009 | Eom | G03G 15/5004 347/129 |
| 9,001,175 | B2 * | 4/2015 | Watanabe | H04N 1/029 347/237 |
| 2016/0077457 | A1 | 3/2016 | Honda et al. | |

FOREIGN PATENT DOCUMENTS

| | | |
|---|---|---|
| JP | H04-369563 | 12/1992 |
| JP | 2004-046914 | 2/2004 |
| JP | 2000-263844 | 9/2009 |

* cited by examiner

*Primary Examiner* — Hoan Tran
(74) *Attorney, Agent, or Firm* — Duft Bornsen & Fettig LLP

(57) ABSTRACT

An image-forming apparatus includes a first opened/closed signal generation unit for generating a first opened/closed signal indicating an opened/closed state of the open/close member by using polling detection; a second opened/closed signal generation unit for generating a second opened/closed signal in which a state indicating the opened state of the open/close member is latched when a second signal via the switch is cut off; and a power-supply failure detection unit for detecting a power-supply failure based on the first and/or second opened/closed signals. The second opened/closed signal indicates in an initial state the closed state of the open/close member, and is returned to the initial state by an initialization command, and the power-supply failure detection unit detects the power-supply failure based on the (Continued)

second opened/closed signal during an image forming period, and based on the first and second opened/closed signals during a period other than the image forming period.

8 Claims, 9 Drawing Sheets

IMAGE FORMING APPARATUS AND POWER SUPPLY FAILURE DETECTION METHOD

CROSS-REFERENCE TO RELATED APPLICATIONS

The present application claims the benefit of priority under 35 U.S.C. §119 of Japanese Patent Application No. 2015-184968, filed Sep. 18, 2015, the contents of which are incorporated herein by reference in their entirety.

BACKGROUND OF THE INVENTION

1. Field of the Invention

The present invention relates to an image forming apparatus and a power supply failure detection method.

2. Description of the Related Art

Conventionally, an image forming apparatus which forms an image by using a laser light source has been known. This kind of image forming apparatus includes in its cabinet an open/close member that can be opened and closed. An opened/closed state of the open/close member is monitored while the image forming apparatus is controlled.

For example, an image forming apparatus having a laser light source, a laser drive unit, a scanner motor, etc., is disclosed in which monitoring control of power supply of the laser light source is switched according to an opened/closed state of the open/close member (for example, refer to Patent Document 1).

SUMMARY OF THE INVENTION

An image forming apparatus includes a cabinet; a laser light source included in the cabinet; a laser drive unit for driving the laser light source; an open/close member included in the cabinet; and a switch for cutting off power supply of the laser drive unit when the open/close member is in an opened state and connecting the power supply to the laser drive unit when the open/close member is in a closed state, and is used for forming an image by using the laser light source. The image forming apparatus includes a first opened/closed signal generation unit configured to generate a first opened/closed signal indicating an opened/closed state of the open/close member by using polling detection in which a first signal via the switch is periodically monitored; a second opened/closed signal generation unit configured to generate a second opened/closed signal in which a state indicating that the open/close member is in the opened state is latched when a second signal via the switch is cut off; and a power supply failure detection unit configured to detect a failure of the power supply based on at least one of the first opened/closed signal and the second opened/closed signal. The second opened/closed signal indicates in an initial state that the open/close member is in the closed state, and is returned to the initial state by an initialization command; the power supply failure detection unit detects the failure of the power supply based on the second opened/closed signal during an image forming period, and detects the failure of the power supply based on the first opened/closed signal and the second opened/closed signal during a period other than the image forming period.

CITATION LIST

Patent Document

[Patent Document 1] Japanese Unexamined Patent Application Publication No. 2000-263844

DETAILED DESCRIPTION OF THE PREFERRED EMBODIMENTS

Figure 1:
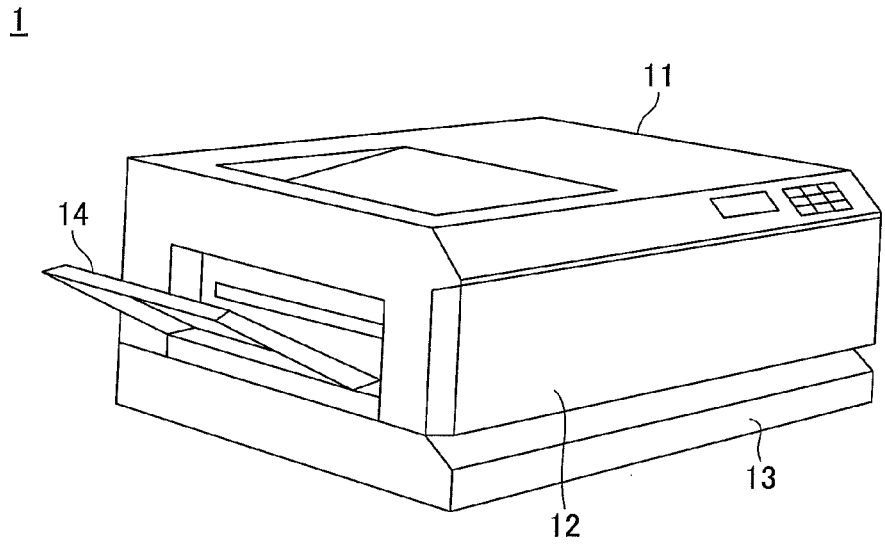
FIG. 1 is a perspective view illustrating an example of an image forming apparatus according to an embodiment.

In view of the above, the present invention has been made. An object of the present invention is to provide an image forming apparatus capable of preventing occurrences of an abnormal image and an unnecessary operation halt.

According to an embodiment, it is possible to provide an image forming apparatus capable of preventing occurrences of an abnormal image and an unnecessary operation halt.

In the following, embodiments of the present invention will be described referring to the drawings.

In each of the drawings, the same numeral is assigned to the same configuration element and a duplicated description may be omitted.

<Description of Image Forming Apparatus>

FIG. 1 is a perspective view illustrating an example of an image forming apparatus 1 according to an embodiment. As illustrated in FIG. 1, the image forming apparatus 1 includes a cabinet 11, a door 12, a paper feeding tray 13, and a paper ejection tray 14. The image forming apparatus includes, for example, a photoconductor, a writing unit, a developing unit, a fixing unit, etc.; irradiates the photoconductor with scanning laser light from a polygon mirror; and forms an image by an electrophotography process. It should be noted that FIG. 1 is only an example illustrating an image forming apparatus 1. The appearance and a structure of the image forming apparatus 1 are not limited to those illustrated in FIG. 1.

Figure 2:
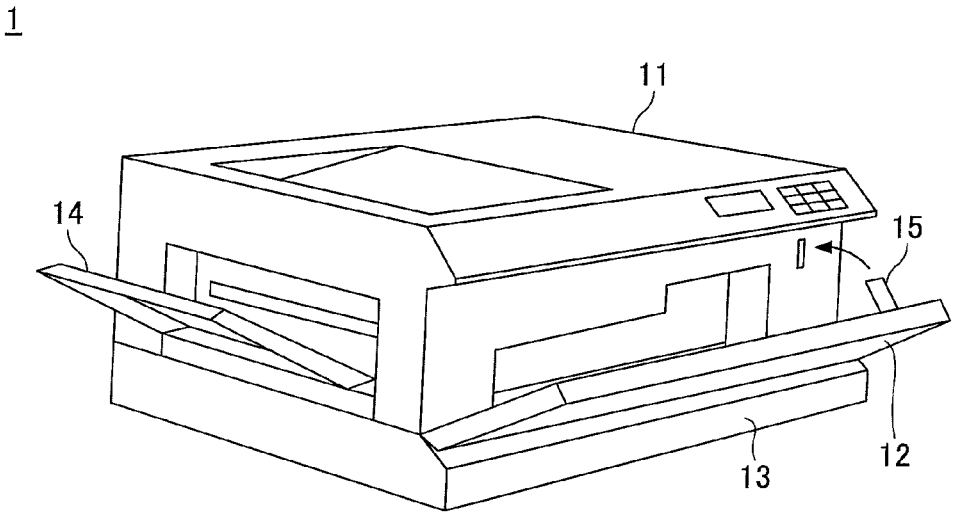
FIG. 2 is a perspective view illustrating an example of a state where a door of the image forming apparatus is opened.

FIG. 2 is a perspective view illustrating an example of a state where the door 12 of the image forming apparatus 1 is opened. As illustrated in FIG. 2, the cabinet 11 includes the door 12 as an open/close member. The door 12 can be opened or closed for maintenance, etc. The door 12 includes a pressing member 15 projecting to the cabinet 11 side.

Figure 3A:
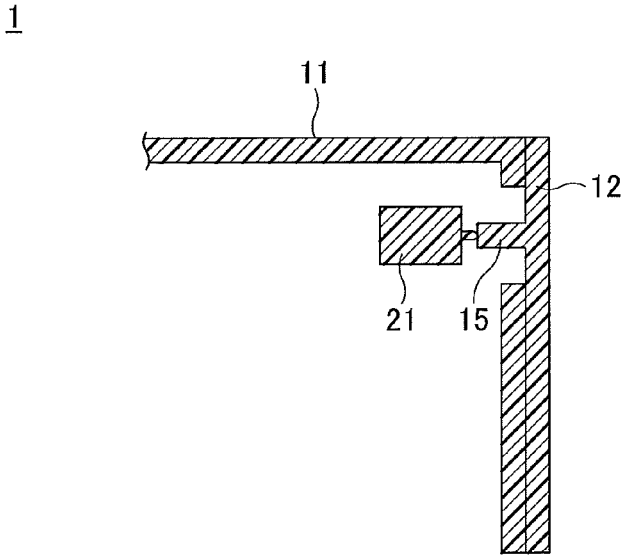
FIG. 3A is a partial cross-sectional view illustrating an example of a state where the door is closed.
Figure 3B:
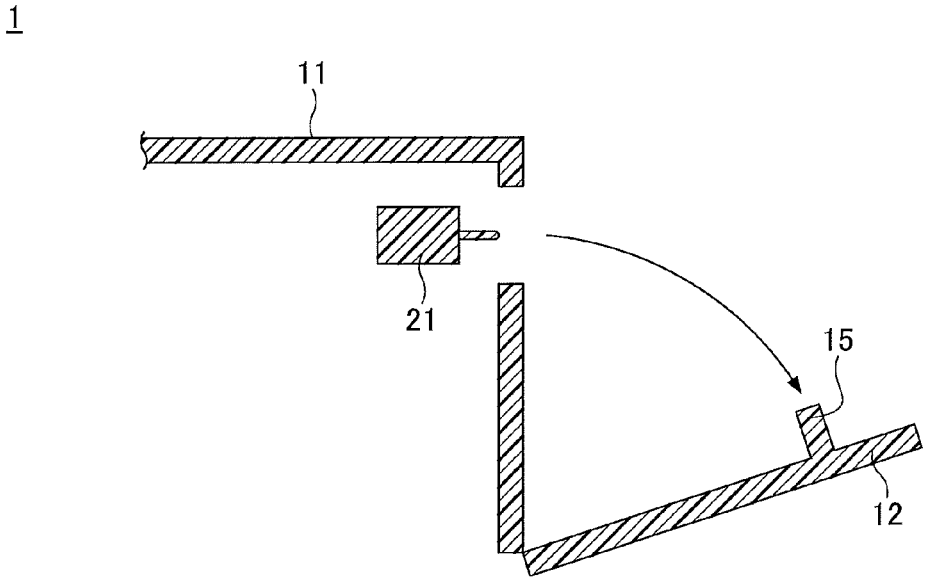
FIG. 3B is a partial cross-sectional view illustrating an example of a state where the door is opened.

FIG. 3A is a partial cross-sectional view illustrating an example of a state where the door 12 is closed. FIG. 3B is a partial cross-sectional view illustrating an example of a state where the door 12 is opened. As illustrated in FIG. 3A and FIG. 3B, inside the cabinet 11, there is a switch 21 for detecting an opened/closed state of the door 12. The switch 21 is a so-called safety switch.

As illustrated in FIG. 3A, when the door 12 is in a closed state, the switch 21 is pressed by the pressing member 15 and is in a conductive (ON) state. Further, as illustrated in FIG. 3B, when the door 12 is in an opened state, the switch 21 is not pressed by the pressing member 15 and is in a cut-off (OFF) state.

Figure 4:
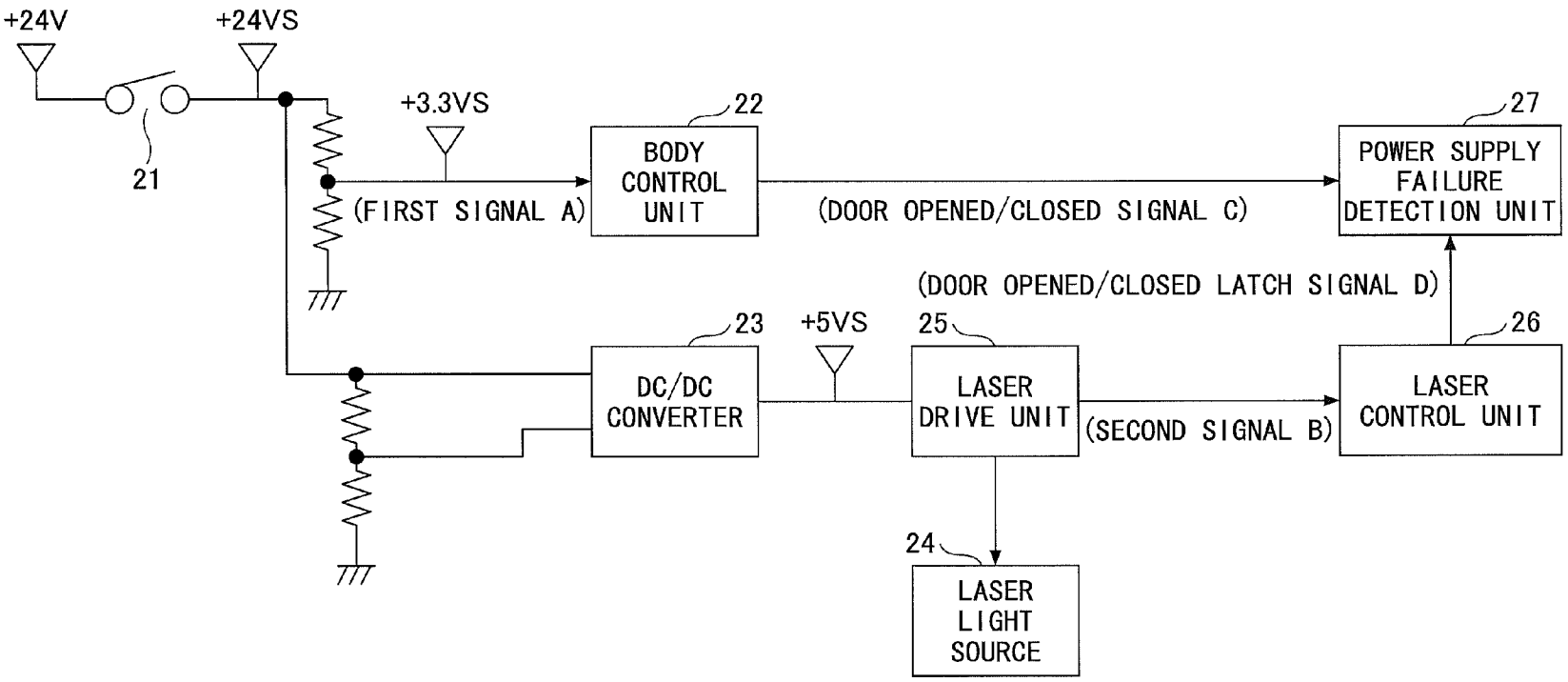
FIG. 4 is a drawing illustrating signals used for detecting an opened/closed state of the door.

FIG. 4 is a drawing illustrating signals used for detecting an opened/closed state of the door 12. The writing unit included in the cabinet 11 of the image forming apparatus 1 includes a laser light source 24, a laser drive unit 25 for driving the laser light source 24, and a laser control unit 26 for controlling the laser drive unit 25. The laser light source 24 is driven by the laser drive unit 25 and emits light. The laser control unit 26 controls emitting light permission and emitting light amount for the laser drive unit 25 when the laser light source 24 emits light.

As illustrated in FIG. 4, for example, there is a +24V power supply in the image forming apparatus 1, and the switch 21 is inserted in a +24V power supply line. Here, +24V after passing through the switch 21 is referred to as "+24 VS".

By dividing +24 VS, +3.3 VS is created and supplied to a body control unit 22 as a signal used for detecting an opened/closed state of the door 12 (hereinafter referred to as a first signal A). It is possible for the body control unit 22 to detect OFF/ON of the switch 21 by monitoring the first signal A.

In FIG. 4, the body control unit 22 monitors +3.3 VS obtained by dividing +24 VS. The body control unit 22 may monitor directly +24 VS, or may monitor a converted voltage other than +3.3 VS. It should be noted that the body control unit 22 is supplied with power independent of the switch 21, and the body control unit 22 can operate regardless of OFF/ON of the switch 21.

By using a DC-DC converter 23, +24 VS is converted to +5 V, and is supplied as power to the laser drive unit 25. Here, +5 V as power supply of the laser drive unit 25 is referred to as "+5 VS". It should be noted that the voltage of the laser drive unit 25 may be other than +5 V.

Also, +5 VS is supplied to the laser control unit 26 as a signal used for detecting an opened/closed state of the door 12 (hereinafter referred to as a second signal B). It is possible for the laser control unit 26 to detect OFF/ON of the switch 21 by monitoring the second signal B. It should be noted that the laser control unit 26 is supplied with power independent of the switch 21, and the laser control unit 26 can operate regardless of OFF/ON of the switch 21.

A detection result of the first signal A by the body control unit 22 (hereinafter, referred to as a door opened/closed signal C) and a detection result of the second signal B by the laser control unit 26 (hereinafter, referred to as a door opened/closed latch signal D) are transmitted to a power supply failure detection unit 27. The power supply failure detection unit 27 detects a failure of power supply (+5 VS) of the laser drive unit 25 based on at least one of the door opened/closed signal C and the door opened/closed latch signal D. A specific detection method of the power supply failure will be described later by referring to FIG. 6, etc.

It should be noted that the body control unit 22, the laser control unit 26 and the power supply failure detection unit 27 may include, for example, a central processing unit (CPU), a read only memory (ROM), a main memory, etc., respectively. In this case, various functions of the body control unit 22, the laser control unit 26 and the power supply failure detection unit 27 can be realized by having a program stored in the ROM, etc., read into the main memory and executed by the CPU. It should be noted that the body control unit 22, the laser control unit 26 and the power supply failure detection unit 27 may be integrated as a single hardware body or may be separate bodies.

Figure 5:
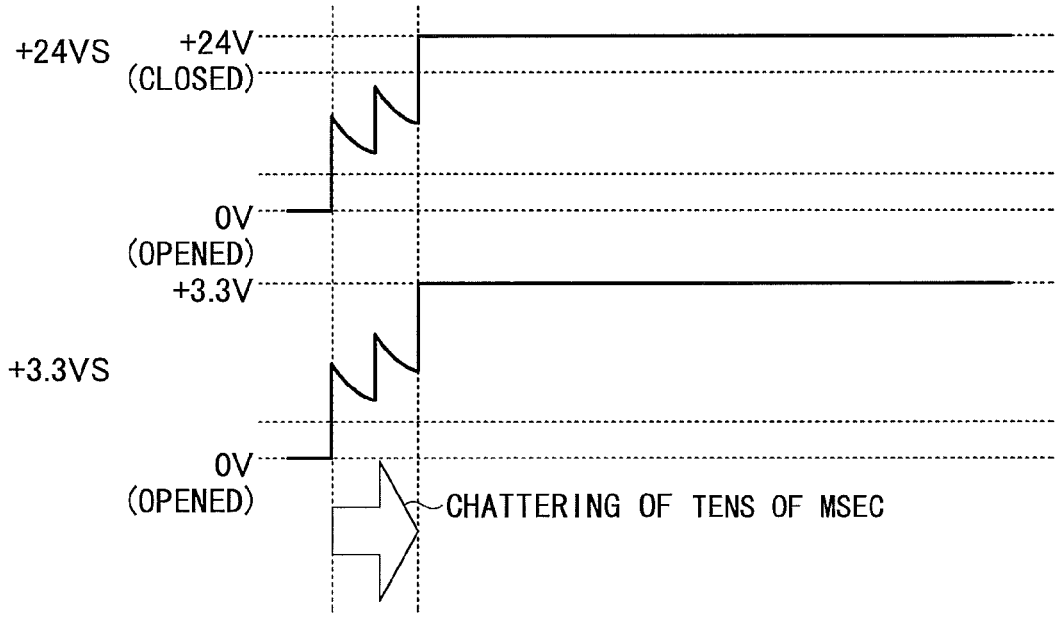
FIG. 5 is a drawing illustrating a chattering which occurs when a switch is closed.

FIG. 5 is a drawing illustrating a chattering which occurs when the switch 21 is closed. As illustrated in FIG. 5, the switch 21 becomes OFF or ON according to opening or closing the door 12. When opening or closing the door 12, a chattering of tens of ms occurs at the beginning of +24 VS and the first signal A (+3.3 VS) divided from the +24 VS. Therefore, it is necessary to prevent false detection due to the chattering. The false detection due to the chattering can be prevented by using polling detection described later.

<Method of Detecting an Opened/Closed State of the Door 12 During a Period Other than an Image Forming (Printing) Period.

Figure 6:
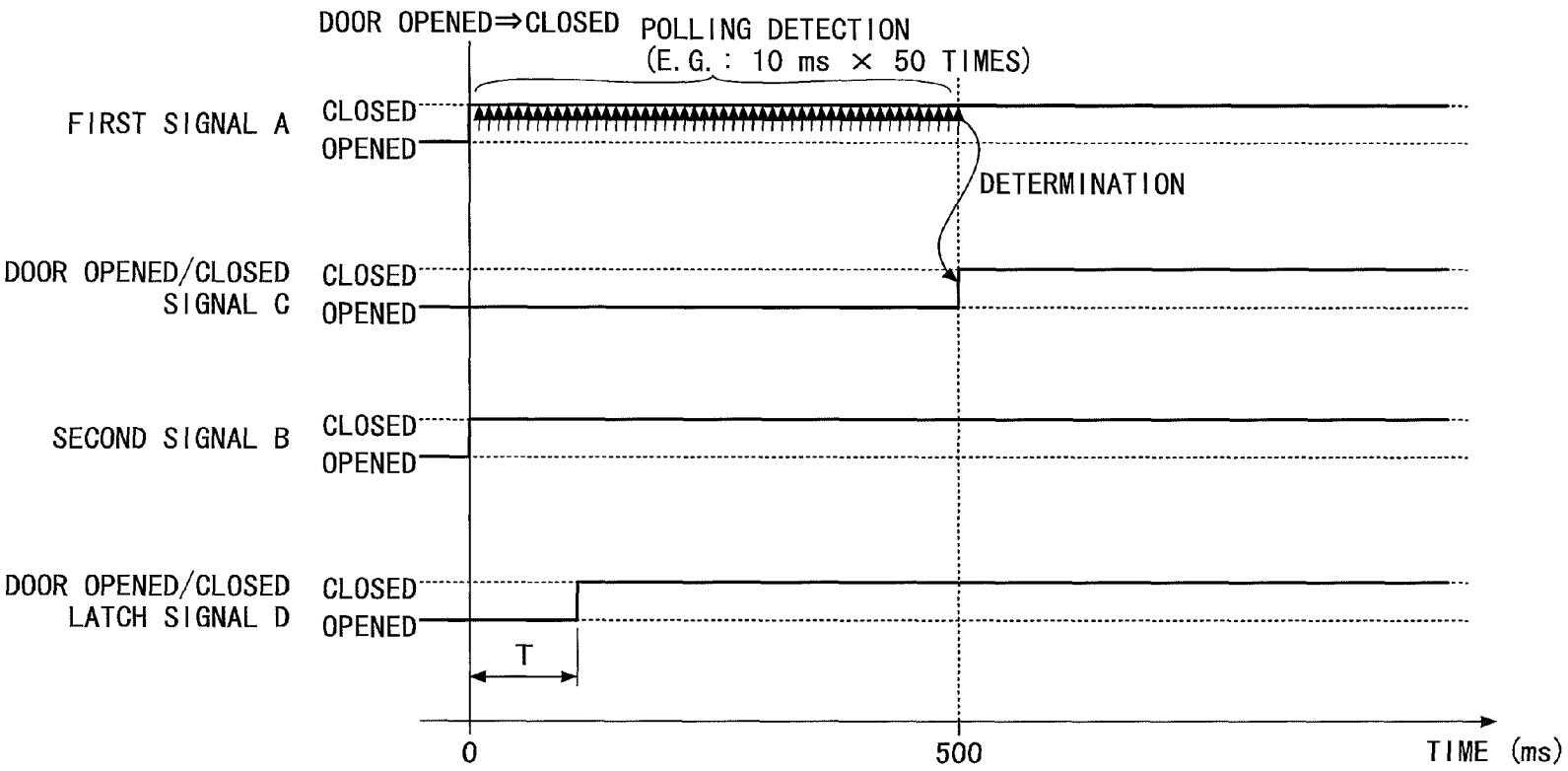
FIG. 6 is a drawing (No. 1) illustrating a method of detecting an opened/closed state of a door during a period other than an image forming period.

FIG. 6 is a drawing illustrating a method of detecting an opened/closed state of the door 12 during a period other than an image forming period. Here, the period other than the image forming period is a period from right after the power supply +5 VS of the laser drive unit 25 becomes ON to right before the laser light source 24 is turned on, or a period when the door 12 is in a closed state and the laser light source 24 is turned off. In a case of FIG. 6, a period from 0 ms to 500 ms is included in the period other than the image forming period.

As illustrated in FIG. 6, when the door 12 transitions from the open state to the closed state, in order to prevent false detection due to the chattering of the switch 21, the body control unit 22 generates the door opened/closed signal C which indicates an opened/closed state of the door 12 by the polling detection in which the first signal A is periodically monitored. In other words, the body control unit 22 switches the state of the door opened/closed signal C to a closed state in the case where the body control unit 22 detects that the first signal A indicates the closed state multiple times in a row by the polling detection when the door opened/closed signal C indicates the opened state. The similar operations will be applied to a case when transitioning from the closed state to the opened state.

For example, the body control unit 22 performs polling every 10 ms. When the first signal A is H for 50 times in a row, it is determined that the door 12 is in the closed state, and the door opened/closed signal C is switched from L to H. It should be noted that during a period for determining that the door 12 is in the closed state (period when the door opened/closed signal C is L), the image forming apparatus 1 does not operate for the sake of safety.

Here, the body control unit 22 is a typical example of a first opened/closed signal generation unit according to an embodiment, and the door opened/closed signal C is a typical example of a first opened/closed signal according to an embodiment.

Further, when the door 12 moves from the opened state to the closed state, the second signal B (power supply +5 VS of the laser drive unit 25) starts. The laser control unit 26 generates the door opened/closed latch signal D from the second signal B. The door opened/closed latch signal D indicates in an initial state that the door 12 is in the closed state (H), and when the door 12 has moved from the closed state to the opened state (when the power supply +5 VS of the laser drive unit 25 is cut off), the door opened/closed latch signal D is immediately switched from H to L, and the state is maintained. Further, the door opened/closed latch signal D returns to the initial state (H) according to an initialization command from the power supply failure detection unit 27. It should be noted that "T" in FIG. 6 is a start-up time of the laser drive unit 25 (hereinafter, referred to as start-up time T).

Here, the laser control unit 26 is a typical example of a second opened/closed signal generation unit according to an embodiment, and the door opened/closed latch signal D is a typical example of a second opened/closed signal according to an embodiment.

Figure 7:
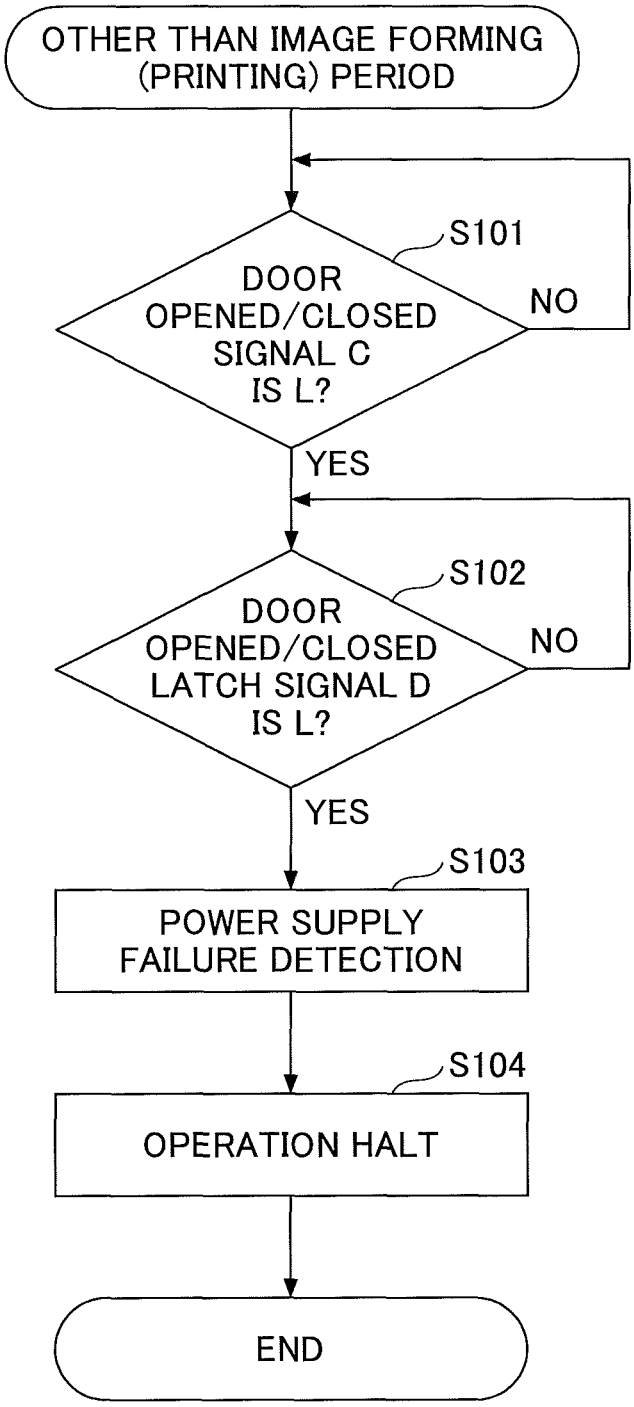
FIG. 7 is a flowchart illustrating a method of detecting an opened/closed state of a door during a period other than the image forming period.

FIG. 7 is a flowchart illustrating a method of detecting an opened/closed state of the door 12 during a period other than the image forming (printing) period. The power supply failure detection unit 27 detects a failure of power supply (+5 VS) of the laser drive unit 25 based on the door opened/closed signal C and the door opened/closed latch signal D during a period other than the image forming (printing) period.

Here, a case is considered where the door 12 is closed and image forming (printing) is not performed. At this time, it is assumed that both the door opened/closed signal D and the door opened/closed latch signal D are H in the initial state.

First, in step S101, the body control unit 22 generates the door opened/closed signal C indicating an opened/closed state of the door 12 according to the polling detection in which the first signal A via the switch 21 is periodically monitored. Further, the power supply failure detection unit 27 monitors whether the door opened/closed signal C becomes L, and, according to the monitoring result, determines whether the door 12 is opened (whether the power supply +5 VS of the laser drive unit 25 is cut off).

In the case where the power supply failure detection unit 27 determines that the door 12 is closed (in the case of NO) in step S101, the process of step S101 is repeated. In the case where the power supply failure detection unit 27 determines that the door 12 is opened (in the case of YES), the process moves to step S102.

Next, in step S102, the laser control unit 26 generates the door opened/closed latch signal D which latches a state indicating that the second signal B via the switch 21 is cut off. Further, the power supply failure detection unit 27 monitors whether the door opened/closed latch signal D becomes L, and, according to the monitoring result, determines whether the door 12 is opened (whether the power supply +5 VS of the laser drive unit 25 is cut off).

In the case where the power supply failure detection unit 27 determines that the door 12 is closed (in the case of NO) in step S102, the process of step S102 is repeated. In the case where the power supply failure detection unit 27 determines that the door 12 is opened (in the case of YES), the process moves to step S103.

Next, in step S103, the power supply failure detection unit 27 detects a power supply failure because the door 12 is opened and the power supply +5 VS of the laser drive unit 25 is cut off. Further, in step S104, the power supply failure detection unit 27 displays, for example, a warning message on a display unit of the image forming apparatus 1, and stops operations (for example, stops accepting input switch, etc).

As described above, during a period other than the image forming (printing) period, the power supply failure detection unit 27 detects that the door 12 is opened based on the door opened/closed signal C and the door opened/closed latch signal D (in the case where the door opened/closed signal C and the door opened/closed latch signal D are both L), and performs halting operations, etc. Here, the door opened/closed signal C is generated by the polling detection, and further, the door opened/closed latch signal D is also monitored, it is possible for the power supply failure detection unit 27 to detect more reliably that the door 12 is opened. In other words, it is possible for the power supply failure detection unit 27 to detect more reliably that the power supply +5 VS of the laser drive unit 25 is in an abnormal state. As a result, it is possible to prevent occurrences of unnecessary operation halt, etc.

Figure 8:
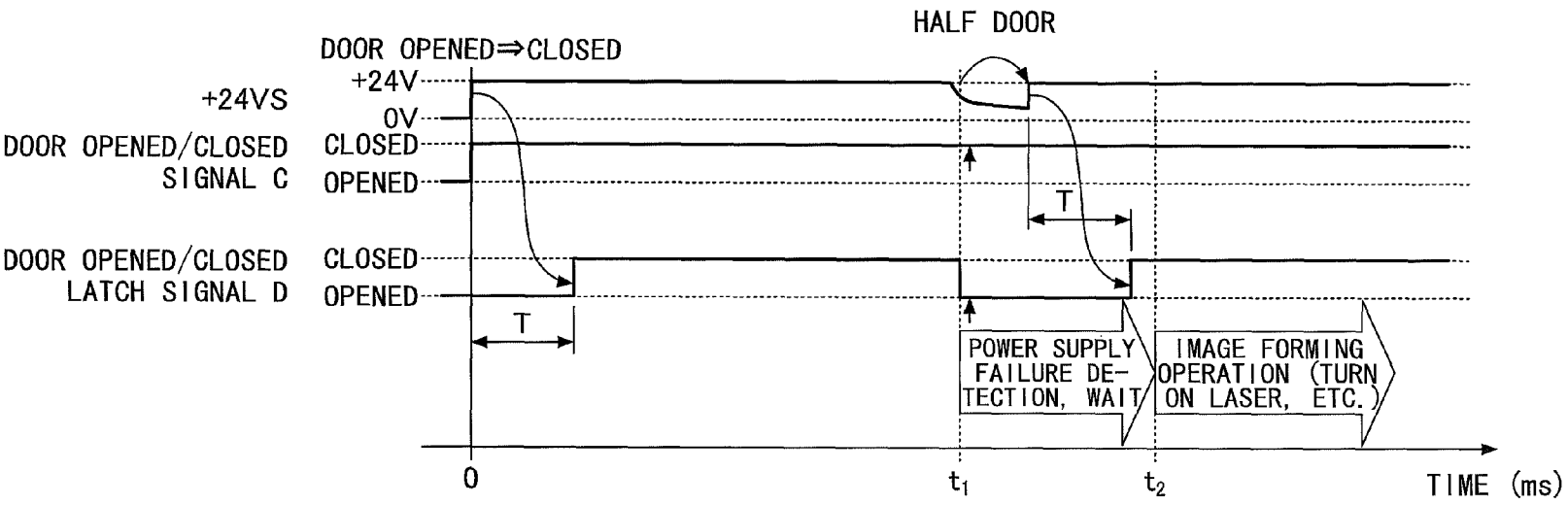
FIG. 8 is a drawing (No. 2) illustrating a method of detecting an opened/closed state of a door during a period other than the image forming period.

It should be noted that, as illustrated in FIG. 8, there is a case where a hardware transient state occurs in which a state of the door opened/closed signal C does not match a state of the door opened/closed latch signal D. In FIG. 8, as an example, a case is illustrated where an instantaneous opening and closing operation of equal to or less than 70 ms is performed for the door 12 (a case of a half door state). In this case, it is considered that, for example, the first signal A has not dropped completely and the second signal B has dropped completely, and thus, a state illustrated in FIG. 8 occurs.

In the case of FIG. 8, at time t1 ms, the power supply failure detection unit 27 detects that the door 12 is in the closed state based on the door opened/closed signal C. At the same time, at time t1 ms, the power supply failure detection unit 27 detects that the door 12 is in the opened state based on the door opened/closed latch signal D (statuses do not match). At this time, after an elapse of a predetermined time equal to or greater than the start-up time T of the laser drive unit 25 (after a wait), for example, at time t2, if the state of the door opened/closed signal C matches the state of the door opened/closed latch signal D, then it is possible to transition to image forming operations (turning on the laser light source 24, etc.)

However, because the states do not match between t1 ms and t2 ms, in spite of the fact that there has been not a power supply failure but an instantaneous opening and closing operation of the door 12, the power supply failure detection unit 27 transmits by mistake an error notification of power supply failure to a predetermined unit in the image forming apparatus 1. Here, originally, the error notification of power supply failure is a notification which is transmitted when states of the door opened/closed signal C and the door opened/closed latch signal D do not match due to an error of a step-down circuit of the body control unit 22, disconnection of power supply route, etc.

Figure 9:
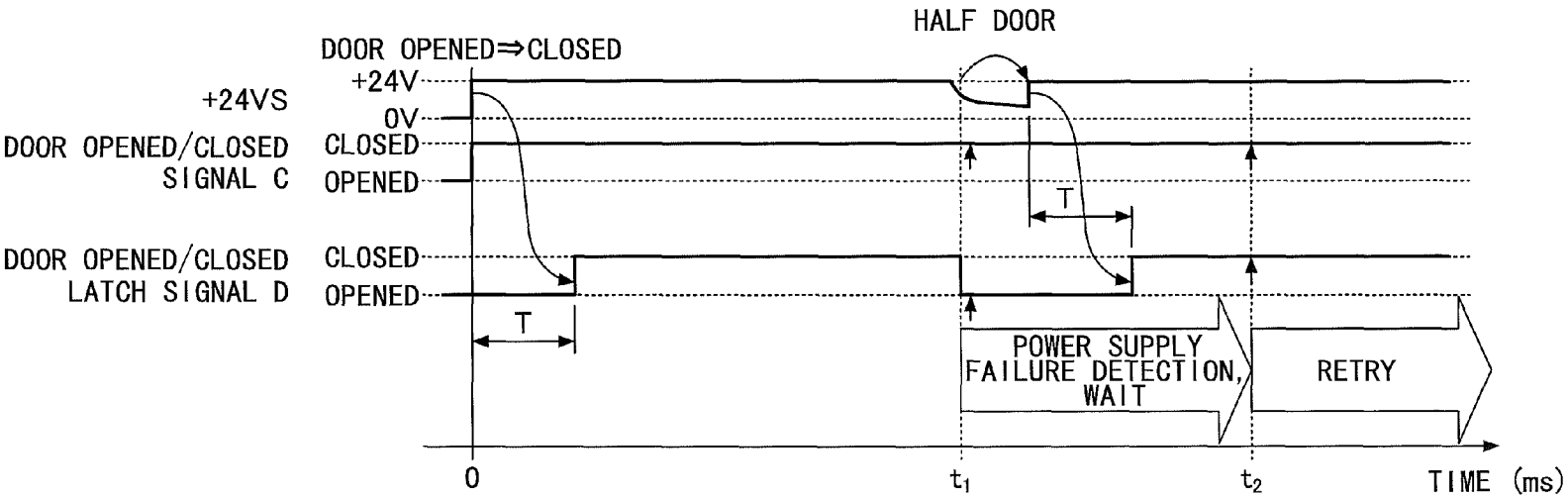
FIG. 9 is a drawing (No. 3) illustrating a method of detecting an opened/closed state of a door during a period other than the image forming period.

In order to avoid this kind of a false notification described above, it is preferable to do as illustrated in FIG. 9. In FIG. 9, the door opened/closed signal C and the door opened/closed latch signal D are compared, and in the case where the states of the signals do not match, the comparison (retry operation) is performed again after an elapse of a predetermined time (after a wait).

Specifically, in FIG. 9, similar to the case of FIG. 8, at time t1 ms, the state of the door opened/closed signal C and the state of the door opened/closed latch signal D do not match. Further, after an elapse of a predetermined time equal to or greater than the start-up time T of the laser drive unit 25 (after a wait), for example, at time t2 ms, a retry operation of power supply failure detection is performed. In FIG. 9, at time t2 ms, the state of the door opened/closed signal C matches the state of the door opened/closed latch signal D.

It is possible to transition to an image forming operation if the state of the door opened/closed signal C matches the state of the door opened/closed latch signal D also in the subsequent retry operation.

In FIG. 9, even in the case where the states do not match at first, the error notification of the power supply failure is not transmitted if the states match in the retry operation. If the mismatch of the states has been detected in the retry operation for multiple times, then it is determined that there is a failure of power supply +5 VS of the laser drive unit 25, and an error notification of the power supply failure is transmitted. It should be noted that the number of retry operations, and how many times the state mismatch must be detected before the error notification of the power supply failure is transmitted can be determined appropriately.

<Method of Detecting an Opened/Closed State of the Door 12 During an Image Forming (Printing) Period>

Figure 10:
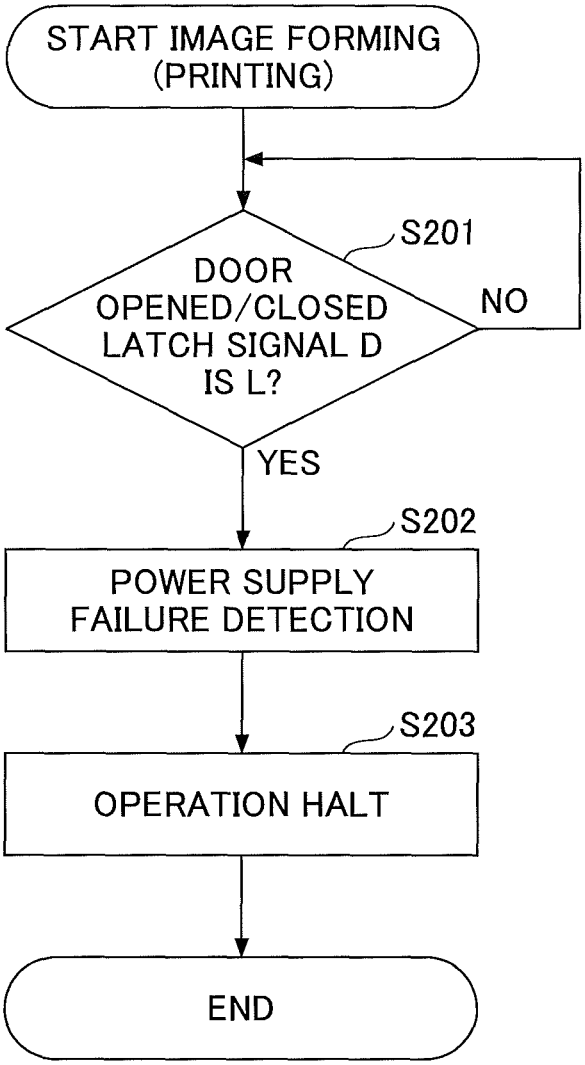
FIG. 10 is a flowchart illustrating a method of detecting an opened/closed state of a door during the image forming period.

FIG. 10 is a flowchart illustrating a method of detecting an opened/closed state of the door 12 during the image forming (printing) period. The power supply failure detection unit 27 detects a failure of power supply (+5 VS) of the laser drive unit 25 based on only the door opened/closed latch signal D during the image forming (printing) period.

Here, a case is considered where the door 12 is closed and image forming (printing) is started. At this time, it is assumed that the door opened/closed latch signal D is H in the initial state.

First, in step S201, the laser control unit 26 generates the door opened/closed latch signal D which latches a state indicating that the second signal B via the switch 21 is cut off. Further, the power supply failure detection unit 27 monitors whether the door opened/closed latch signal D becomes L, and, according to the monitoring result, determines whether the door 12 is opened (whether the power supply +5 VS of the laser drive unit 25 is cut off).

In the case where the power supply failure detection unit 27 determines that the door 12 is closed (in the case of NO) in step S201, the process of step S201 is repeated. In the case where the power supply failure detection unit 27 determines that the door 12 is opened (in the case of YES), the process moves to step S202.

Next, in step S202, the power supply failure detection unit 27 detects a power supply failure because the door 12 is opened and the power supply +5 VS of the laser drive unit 25 is cut off. Further, in step S203, the power supply failure detection unit 27 stops operations of the image forming apparatus 1. Here, stopping operations means stopping printing operation, and specifically means turning off the laser light source, stopping fixing operations, stopping various types of drive motors, etc.

As described above, when the door 12 is opened, the power supply failure detection unit 27 immediately detects that the door 12 is opened base on the result of monitoring the door opened/closed latch signal D, and stops operations of the image forming apparatus 1. With the above operations, it is possible to prevent unnecessary light emission of the laser light source when the door 12 is opened and it is also possible to prevent forming an abnormal image as a result of the power supply being not supplied during image forming.

As described above, in the image forming apparatus 1, it is possible to reliably prevent an occurrence of an abnormal image by immediately detecting a failure of power supply +5 VS of the laser drive unit 25 by a latch detection during an image forming period. Further, it is possible to reliably detect a failure of power supply +5 VS of the laser drive unit 25 by using the polling detection and the latch detection during a period other than the image forming period, and prevent an occurrence of unnecessary operation halts.

The preferred embodiments have been described. However, the embodiments are not limited to as described above, and various modifications and replacements may be applied to the above embodiments without departing from the scope of claims.

For example, regarding L and H used in describing a logic according to an embodiment, an opposite logic be used.

The present application is based on and claims the benefit of priority of Japanese Priority Application No. 2015-184968 filed on Sep. 18, 2015, the entire contents of which are hereby incorporated herein by reference.

What is claimed is:

1. An image forming apparatus including a cabinet; a laser light source included in the cabinet; a laser drive unit for driving the laser light source; an open/close member included in the cabinet; and a switch for cutting off power supply of the laser drive unit when the open/close member is in an opened state and connecting the power supply to the laser drive unit when the open/close member is in a closed state, used for forming an image by using the laser light source, the image forming apparatus comprising:

a first opened/closed signal generation unit configured to generate a first opened/closed signal indicating an opened/closed state of the open/close member by using polling detection in which a first signal via the switch is periodically monitored;

a second opened/closed signal generation unit configured to generate a second opened/closed signal in which a state indicating that the open/close member is in an opened state is latched when a second signal via the switch is cut off; and a power supply failure detection unit configured to detect a failure of the power supply based on at least one of the first opened/closed signal and the second opened/closed signal, wherein the second opened/closed signal indicates in an initial state that the open/close member is in the closed state, and is returned to the initial state by an initialization command, and wherein the power supply failure detection unit detects the failure of the power supply based on the second opened/closed signal during an image forming period, and detects the failure of the power supply based on the first opened/closed signal and the second opened/closed signal during a period other than the image forming period.

2. The image forming apparatus according to claim 1, wherein the first opened/closed signal generation unit switches the first opened/closed signal to a state indicating the opened state in the case where, when the first opened/closed signal indicates the closed state, the first opened/closed signal generation unit detects the opened state multiple times in a row by the polling detection.

3. The image forming apparatus according to claim 1, wherein the power supply failure detection unit compares the first opened/closed signal with the second opened/closed signal during the period other than the image forming period, and in the case where the state of the first opened/closed signal does not match the state of the second opened/closed signal, the power supply failure detection unit performs the comparison again after an elapse of a predetermined time.

4. The image forming apparatus according to claim 3, wherein the power supply failure detection unit determines the failure of the power supply in the case where, as a result of the comparison, it has been detected for multiple times that the state of the first opened/closed signal does not match the state of the second opened/closed signal.

5. The image forming apparatus according to claim 4, wherein the power supply failure detection unit transmits an error notification in the case where the failure of the power supply is determined.

6. The image forming apparatus according to claim 1, wherein the period other than the image forming period is a period from right after the power supply is connected to the laser drive unit to right before the laser light source is turned on, or a period when the open/close member is in the closed state and the laser light source is turned off.

7. A power supply failure detection method for detecting a failure of power supply in an image forming apparatus including a cabinet; a laser light source included in the cabinet; a laser drive unit for driving the laser light source; an open/close member included in the cabinet; and a switch for cutting off the power supply of the laser drive unit when the open/close member is in an opened state and connecting the power supply to the laser drive unit when the open/close member is in a closed state, used for forming an image by using the laser light source, the power supply failure detection method comprising:

generating a first opened/closed signal indicating an opened/closed state of the open/close member by using polling detection in which a first signal via the switch is periodically monitored;

generating a second opened/closed signal in which a state indicating that the open/close member is in the opened state is latched when a second signal via the switch is cut off; and detecting a failure of the power supply based on at least one of the first opened/closed signal and the second opened/closed signal, wherein the second opened/closed signal indicates in an initial state that the open/close member is in the closed state, and is returned to the initial state by an initialization command, and wherein the detecting a failure of the power supply detects the failure of the power supply based on the second opened/closed signal during an image forming period, and detects the failure of the power supply based on the first opened/closed signal and the second opened/closed signal during a period other than the image forming period.

8. An image forming apparatus including a cabinet; a laser light source included in the cabinet; a laser drive unit for driving the laser light source; an open/close member included in the cabinet; and a switch for cutting off power supply of the laser drive unit when the open/close member is in an opened state and connecting the power supply to the laser drive unit when the open/close member is in a closed state, used for forming an image by using the laser light source, the image forming apparatus comprising:

a first opened/closed signal generation means for generating a first opened/closed signal indicating an opened/closed state of the open/close member by using polling detection in which a first signal via the switch is periodically monitored;

a second opened/closed signal generation means for generating a second opened/closed signal in which a state indicating that the open/close member is in an opened state is latched when a second signal via the switch is cut off; and a power supply failure detection means for detecting a failure of the power supply based on at least one of the first opened/closed signal and the second opened/closed signal, wherein the second opened/closed signal indicates in an initial state that the open/close member is in the closed state, and is returned to the initial state by an initialization command, and wherein the power supply failure detection means detects the failure of the power supply based on the second opened/closed signal during an image forming period, and detects the failure of the power supply based on the first opened/closed signal and the second opened/closed signal during a period other than the image forming period.

* * * * *